United States Patent [19]

Wronka

[11] 4,387,464

[45] Jun. 7, 1983

[54] VESSEL FOR AN ELECTRO FURNACE

[75] Inventor: Bodo Wronka, Duisburg, Fed. Rep. of Germany

[73] Assignee: Mannesmann Aktiengesellschaft, Dusseldorf, Fed. Rep. of Germany

[21] Appl. No.: 278,009

[22] Filed: Jun. 26, 1981

[30] Foreign Application Priority Data

Jun. 28, 1980 [DE] Fed. Rep. of Germany ..... 3024549

[51] Int. Cl.[3] ..... F27D 1/14

[52] U.S. Cl. ..... 373/76; 432/248

[58] Field of Search ..... 13/32, 35; 373/76, 75, 373/73; 432/248; 266/281

[56] References Cited

U.S. PATENT DOCUMENTS

| | | | |
|---|---|---|---|
| 3,088,722 | 5/1963 | Slesaczek | 432/248 X |
| 3,962,528 | 6/1976 | Wynne | 13/35 |
| 3,984,613 | 10/1976 | Reese . | |
| 4,123,617 | 10/1978 | Wynne . | |

FOREIGN PATENT DOCUMENTS

| | | | |
|---|---|---|---|
| 2037412 | 7/1980 | United Kingdom | 13/35 |
| 402547 | 3/1972 | U.S.S.R. | 266/281 |

*Primary Examiner*—Roy N. Envall, Jr.

*Attorney, Agent, or Firm*—Mandeville and Schweitzer

[57] ABSTRACT

A support vessel for a metallurgical furnace having circumferentially spaced vertical support members which are laterally removable, as desired, from the area of the vessel wall. In one embodiment of the invention, the vertical supports are pivotally positioned at one end of the vessel wall.

5 Claims, 2 Drawing Figures

VESSEL FOR AN ELECTRO FURNACE

BACKGROUND OF THE INVENTION AND DESCRIPTION OF THE PRIOR ART

The invention relates to a vessel for an electro furnace, particularly a type furnace with walls consisting entirely or at least partially, in the area above the melting zone, merely of joined-together, exposed cooling elements, with an upper edge on which the cover of the vessel rests, in which the edge is connected by means of supports extending on the outside of the vessel wall parallel to the vessel rotary axis, to the support frame of the vessel bottom.

Furnace vessels for metal melting furnaces with a heat-constant wall, which is entirely or at least partially built of cooling blocks, are known, for example, from DE-OS 27 45 622 and DE-OS 27 36 385.

With that type of furnace it is necessary to replace, periodically, the cooling elements which are joined into blocks and which form the vessel wall.

However, in the case of electro furnaces of conventional design, with walls having a refractory lining, the refractory lining must also be regularly renewed.

The replacement of the vessel wall in today's construction of electro furnace is time consuming and expensive. The vessel wall is ordinarily surrounded by a support frame essentially consisting of supports extending parallel to the vessel rotary axis (DE-OS 28 19 836—position 30; DE-OS 26 40 598—positions 44, 46, and 48). The support frame, however, prevents restoration work from being done from the outside, and therefore, the repair crew must work in the interior of the vessel.

In many cases it is more advantageous, for work on refractory linings, if the vessel is accessible for the maintenance crew from the outside. Additionally, various aid mechanisms may, furthermore, be more conveniently installed if the furnace is not necessarily cooled off to a degree it would have to be cooled for work to be done in its interior and, finally, in certain cases the removed material may easily be removed towards the outside.

A method for removing vessel walls from an electric arc furnace is known from DE-OS 26 40 598, in which the support frame is lifted off the furnace with the aid of a crane (page 17, line 23 et. seq.; page 18, first paragraph and FIG. 3). To this end the jacket construction may be disconnected from the support frame 12 of the lower part; it is obvious that such work is very expensive, adding to operational cost. Furthermore, the entire heavy jacket construction is handled which may sometimes be cumbersome in the narrow space available in the furnace sheds.

SUMMARY OF THE INVENTION

The present invention has the objective of developing a vessel of the type initially mentioned, the design of which would considerably facilitate restoration work at the vessel wall. According to the present invention, this problem is solved by making a part of the supports of the support frame laterally removable from the area of the vessel wall.

A further characteristic of the present invention is that the removable supports are pivotally positioned at one end of the vessel wall.

The pivot axis is advantageously arranged in such a manner that it extends tangentially to the vessel wall.

Yet another aspect of the present invention is that the pivot may be arranged at the support frame of the vessel bottom.

A still further aspect of the present invention resides in the fact that the removable supports are connected to the vessel by screws or wedges.

The present invention is explained by way of an exemplary embodiment and the figures.

DETAILED DESCRIPTION OF THE DRAWING

Figure 1:
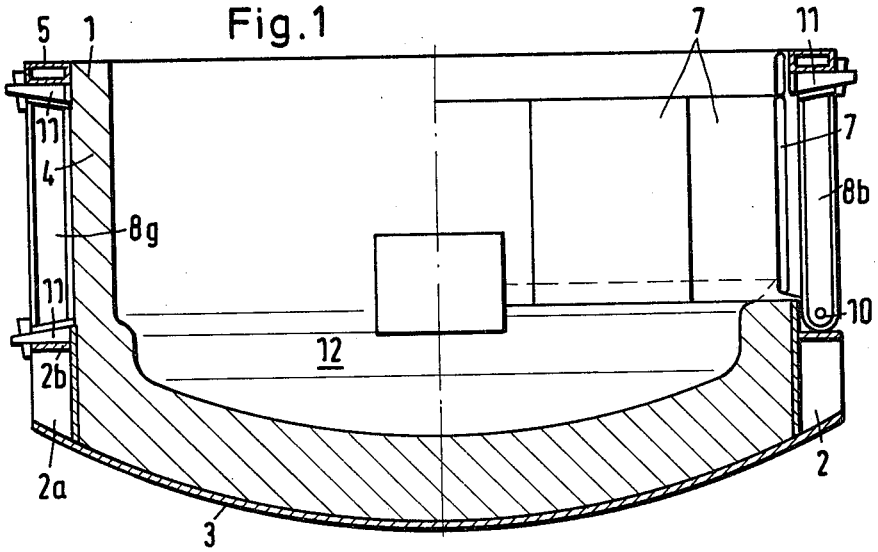
FIG. 1 is an axial section of a vessel, according to the invention, of a tiltable arc furnace.
Figure 2:
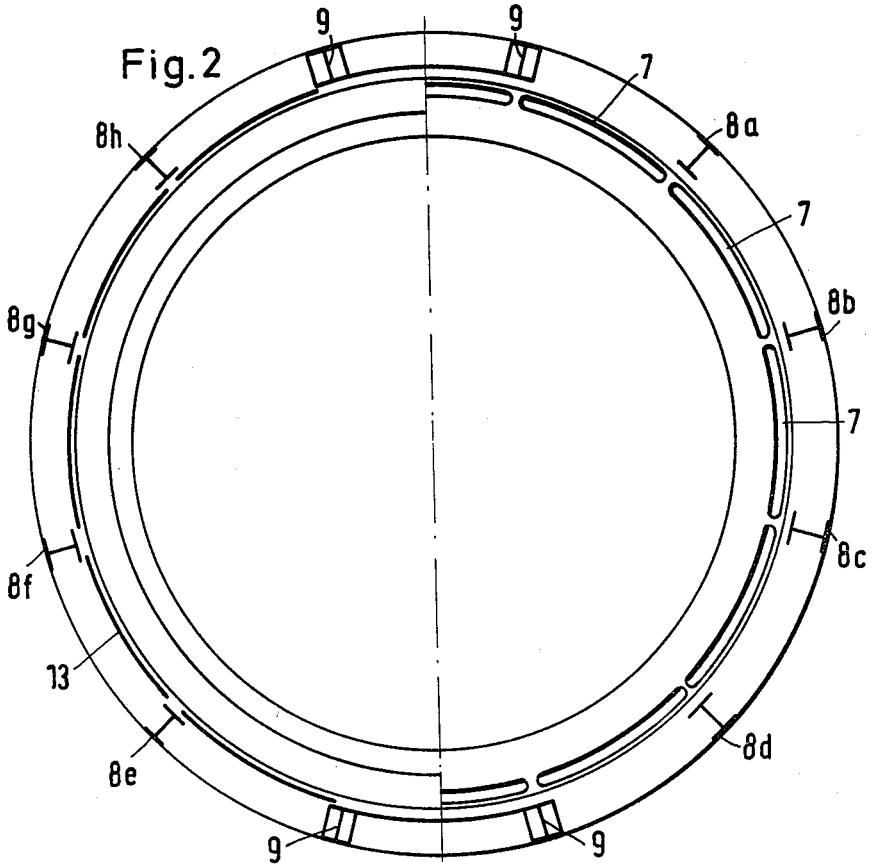
FIG. 2 is a top view of the furnace according to FIG. 1.

As FIGS. 1 and 2 show, the vessel has the shape of a low cylinder, with a bottom 3 curved downwardly when viewed from the bottom of the vessel. The upper closure of the vessel consists of a cover which may be lifted and lowered, and through which electrodes can pass. The illustration does not show the cover or the electrodes.

The lower area of the vessel contains the melting zone 12, where the metal melts and collects during the operation of the furnace.

FIGS. 1 and 2 show two exemplary embodiments of the vessel, i.e., in the left part is a vessel with wall 4 lined with brick to the top, while the right part of the illustration shows another embodiment wherein the refractory inlet 1 of the furnace hearth reaches only slightly above the melt level. The adjacent part above the furnace wall consists of cooling elements (pipe bundles) 7 which are exposed inwardly towards the melting zone 12, with coolants flowing through. The cooling elements 7 are connected to a circuit, not illustrated.

The bottom area of the vessel 3 is provided with a support frame 2. The construction 2 has vertically arranged supports **2*a* distributed around the circumference of the vessel, said supports being connected to a horizontally arranged, ring-shaped belt 2*b*. Supports 8*a*–8*h*, extend parallel to the vessel rotary axis, and are connected to this belt, said supports supporting the vessel top ring 5 which protrudes above the cross section of the vessel. This support is very important since, during the furnace operation, the vessel top ring 5** carries the entire weight of the furnace cover.

The supports **8*a*–8*h* are laterally removable, in order to facilitate—as previously explained—access to the lateral inlet or, as applicable, the manipulation of the wall of the vessel from the outside. As is shown in FIG. 1, the support 8 is pivotally positioned at its lower end at 10 at the belt 2*b*. To this end, a bearing is arranged at the belt 2*b*. The pivotal axis 10 extends tangentially to the wall of the vessel 4**.

The upper end of the support **8*b* is connected, via a wedge 11 which cannot be moved, to the underside of the vessel top ring 5**.

The supports **8*a*–8*h* are held in relative place by holding pins (not separately numbered in the drawings) which pass through apertures of the wedges 11. The shape of wedges 11** serves to retain the supports in relative vertical position unless and until the holding pins are first removed from the wedges. Only then can the supports be displaced for removing the supports from the outside surface of the vessel.

In lieu of using the illustrated wedge elements 11 and holding pins, as shown in the drawing, screw type fasteners can be used or any other equivalent type holding devices which can be selectively released, as desired.

If, for instance, a cooling element (cooling-pipe bundle) 7 is to be repaired or exchanged, the wedge connection is detached at 11 and the support **8*b* is swivelled away from the vessel wall 4**. This makes the vessel wall accessible for servicing from the outside.

The support **8*g* is connected at its lower as well as its upper end via wedges 11 to the belt 2*b* and the vessel top ring 5. After undoing the wedge connection, the support 8*g* may be laterally removed, which makes the lining 1** accessible from the outside. Repair work at the lining way then be done from the outside.

As FIG. 2 shows, four stationary supports 9, appropriately spaced, are arranged, which serve to balance the tension in the support frame. For the same purpose, loose jacket metal-sheets 13 are placed between the supports **8*a*** and the lined wall.

It should be understood, of course, that the specific forms of the invention herein illustrated and described are intended to be representative only, as many changes may be made therein without departing from the clear teachings of the disclosure. Accordingly, reference should be made to the following appended claims in determining the full scope of the invention.

What is claimed is:

1. A metallurgical vessel comprising (a) a furnace bottom for containing a melt, said furnace bottom being lined with refractory material, (b) side walls extending above the top surface of said melt, said side walls comprising a plurality of side wall forming elements, (c) a support ring extending around said furnace beneath the top surface of said melt, and a vessel top ring extending around said furnace adjacent the top of said side walls (d) a plurality of spaced, vertically extending support members which are fixed by connecting means, during the operation of the vessel, to said support ring, and said top ring yet, are completely, laterally, selectively removable from said vessel side walls by release of at least said connecting means at said top ring to provide exterior access to said vessel, and (e) a vessel cover supported on the surfaces formed by said top ring of said supports.

2. A vessel as claimed in claim 1, wherein (a) said side wall forming elements are water cooled pipes.

3. A vessel as claimed in claim 1, wherein (a) said side wall forming elements are refractory bricks.

4. A vessel as claimed in claim 1, wherein (a) said connecting means comprise wedges and locking pins.

5. A vessel as claimed in claim 1, wherein (a) said support members are pivotally connected on one end to said support ring such that upon selective release of said top ring connecting means the free ends of said support members pivot away from the exterior of said vessel.

* * * * *